US005914697A

United States Patent [19]

Seki

[11] Patent Number: 5,914,697

[45] Date of Patent: Jun. 22, 1999

[54] METHOD OF FABRICATING RADIO DEVICE HELICAL ANTENNAS

[75] Inventor: Kouichi Seki, Ageo, Japan

[73] Assignee: Nippon Antena Kabushiki Kaisha, Tokyo, Japan

[21] Appl. No.: 08/952,695

[22] PCT Filed: Mar. 11, 1997

[86] PCT No.: PCT/JP97/00760

§ 371 Date: Dec. 2, 1997

§ 102(e) Date: Dec. 2, 1997

[87] PCT Pub. No.: WO97/37400

PCT Pub. Date: Oct. 9, 1997

[30] Foreign Application Priority Data

Apr. 3, 1996 [JP] Japan ..... 8-104753

[51] Int. Cl.[6] ..... H01Q 11/08

[52] U.S. Cl. ..... 343/895; 343/895; 343/749; 343/866

[58] Field of Search ..... 343/895, 749, 343/872, 873, 866; 144/329, 331

[56] References Cited

U.S. PATENT DOCUMENTS

| | | | |
|---|---|---|---|
| 3,055,003 | 9/1962 | Marston et al. | 343/756 |
| 3,093,171 | 6/1963 | Bean et al. | 144/331 |
| 4,843,404 | 6/1989 | Benge et al. | 343/895 |
| 5,790,477 | 6/1997 | Hauke | 368/10 |

FOREIGN PATENT DOCUMENTS

| | | | |
|---|---|---|---|
| 4-67807 | 6/1992 | Japan | 11/8 |
| 5-36917 | 5/1993 | Japan . | |
| 07302716 | 11/1995 | Japan | 21/6 |

*Primary Examiner*—Don Wong
*Assistant Examiner*—James Clinger
*Attorney, Agent, or Firm*—Pollock, Vande Sande & Amernick

[57] ABSTRACT

A portable radio device helical antenna 1 is fabricated by a method wherein the cutting boss component 6 of a molded element 7, that has a spirally cut groove 4 formed around an insulator and that has a mounting component 3 at one end and the boss component 6 at the other end, is chucked, the components are metal plated, the metal layer is then removed except from the groove 4 and mounting component 3, the boss component 6 is then cut off and that location is machined, and a radio device base plate fixing hole 9 is formed in the mounting component 3. The mounting component 3 is then mounted on the base plate of a radio device main body.

10 Claims, 15 Drawing Sheets

PRIOR ART

PRIOR ART

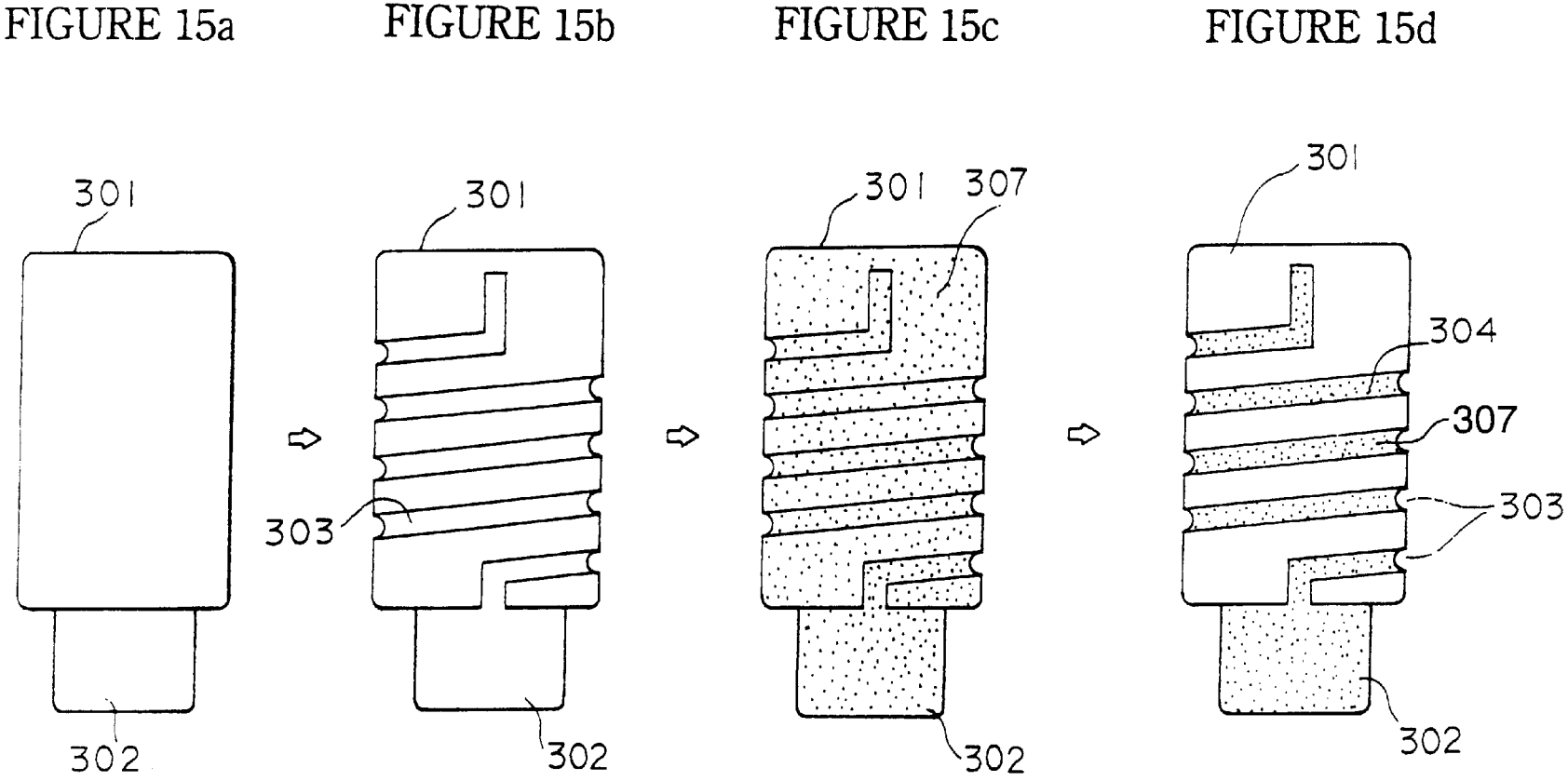
PRIOR ART

METHOD OF FABRICATING RADIO DEVICE HELICAL ANTENNAS

BACKGROUND OF THE INVENTION

1. Field of the Invention

The present invention relates to a helical antenna for portable radio devices, formed by means of a coated conductive layer around an insulator, and in which a coil component and mounting component are integrally formed, as well as to its method of manufacture.

2. Description of Related Art

Helical antennae with spirally shaped coil elements are widely used in portable radio devices such as portable telephones.

An example of a coil which is used in such conventional helical antennae is depicted in FIG. 13.

As shown in the figure, a helical antenna 100 comprises a cover component 101, a coil component 102, and a mounting component 103, with the coil component 102 housed inside the cover component 101, and the mounting component, which is used to join the antenna to the radio device, located at the bottom end.

FIG. 14 shows an example of a coil with another structure 200 used in helical antennae, which are fabricated by providing a spiral groove 202 around the sides of an insulated, columnar body 201, and by then providing a plating layer 203 on the concave surface of the spiral groove 202. The spiral antenna 200 is alternatively fabricated by forming a plating layer 203 on the insulated, columnar body 201 having the spiral groove 202, either in its entirety or on the entire side surface thereof; finally removing the excess plating layer 203 on the outermost layer of the side surface of the insulated, columnar body 201 by grinding it or the like; and leaving the plating layer 203 on the concave surface of the spiral groove 202.

The method for manufacturing a coil element, which is noted in Japanese Laid-Open Patent Application 7-302716, is described below with reference to FIG. 15.

As shown in FIG. 15*a*, 302 is a mounting component of, an insulated cylindrical main body 301. A spiral groove 303 is provided, as shown in FIG. 15*b*, around the outer peripheral side surface of the main body 301. A conductive layer 307 consisting of a metal is then allowed to adhere by means of plating or the like to the entire surface of the main body 301 and the mounting component 302, resulting in the state depicted in FIG. 15*c*. The outer peripheral side surface of the main body 301 is then machined with a lathe or the like, and the upper surface of the main body 301 is ground.

When this is done, the conductive layer 307 that adheres to the bottom of the main body 301 and inside the groove 303, and that has been formed on the surface of the mounting component 302, is left, and the conductive layer 307 adhering to the outer peripheral side surface of the main body 301 is removed by machining. This results in the manufacture of the coil element depicted in FIG. 15*d*, which is furnished with a coil component 304 formed by the conductive layer 307 in the groove 303.

The helical antenna depicted in FIG. 13, however, suffers from the drawbacks of higher manufacturing costs and irregular electrical properties because it is constructed by assembling a coil component, cover component, and mounting component with individual parts.

When electrical power is applied to the spiral antenna on which a spiral groove has been formed, as shown in FIG. 14, electrical power can be supplied only by soldering a lead to the plating layer 203 formed in the groove, resulting in the inconvenience of the working procedures needed for the supply of electrical power.

As shown in FIG. 15, the device is integrated with the mounting component, but the device depicted in FIG. 15 suffers from drawbacks in that the thinness and the high degree of hardness of the plating layer result in poor workability, causing the plating layer to be broken during the machining process, or burrs are produced in the plating layer as a result of the machining, and so forth, so that irregularities are produced in the electrical properties of the coil element. Particularly when a cover is molded over the coil element, the risk of burrs adhering to undesirable parts during molding results in the deterioration of the electrical properties and quality.

In addition, when a helical antenna is used in a portable telephone or portable radio device, such devices are frequently used in poor environments involving rugged use and exposure to wind and rain, with considerable external force exerted on the antenna component. When conventional helical antennae are mounted on radio device main bodies, problems include insufficient mechanical strength and a poor water-proof mechanism.

Furthermore, when portable radio devices are dropped or the like, and when force is obliquely exerted on the antenna and the like, there are problems in that the impact received by the antenna is transmitted as such to the base plate of the radio device main body, damaging the base plate.

SUMMARY OF THE INVENTION

An object of the present invention is to provide a helical antenna that is less expensive, that has fewer electrical property irregularities, that is easy to mount, that has better mechanical strength, and that has excellent water-proofness, as well as a method for its manufacture.

To achieve the aforementioned objectives, the method for manufacturing a helical antenna in the present invention is such that the cutting boss component of a first molded element, which has a spiral groove formed around an insulator and which has a mounting component at one end and the aforementioned boss component at the other, is chucked, the components are plated, the metal layer is then removed except from the aforementioned groove and mounting component, and the boss component is subsequently cut off, so as to form a helical antenna in which the coil main body and mounting component are integrated.

In the method of forming the helical antenna of the present invention using a metal layer to coat a first molded element that has a spiral groove formed around an insulator and that has a mounting component at one end, and then removing the metal layer except from the aforementioned groove component and mounting component, the mounting component is electrically connected integrally with the coil main body constituting the helical antenna, and said mounting component is mounted on the base plate of a radio device main body so as to electrically connect the aforementioned helical antenna with the radio device main body.

The method of forming the helical antenna of the present invention further involves providing an annular protruding rib, O-ring, or concave-convex component to a cover component integrally formed with the coil main body or to a separately formed cover component. The radio device main body case cover can also be used as such for the cover of the coil main body.

The bottom of the coil main body may also be provided with a fitting component of roughly the same diameter as that of the coil main body, and the bottom of said fitting component may also be provided with a mounting component that is electrically connected to the coil component. In this case, the mounting component may also have a threaded structure.

Because the boss component in the present invention can thus be used as a chucking component during the cutting and machining processes, it can be held when cut, regardless of the shape of the mounting component, allowing the cutting and machining work to be managed more easily.

Additionally, the coil main body and mounting component are electrically connected in an integral manner, and the antenna is electrically connected to the base plate of the radio device main body by means of the mounting component, so irregularities in the electrical properties can be reduced.

The integral formation of a cover component with the coil main body also allows manufacturing costs to be reduced, and inserting an O-ring or rib into the cover component allows the air-tightness and the water-proof capacity to be improved. Also, when the helical antenna is assembled with the radio device main body using the radio device case cover as a cover for the coil main body, no separate cover is needed for the coil main body, the air-tightness is improved, and no additional water-proof means is needed.

A structure in which the cover component is joined to the cylindrical rim of a radio device main body, or a structure in which the mounting component is threaded and easily screwed onto the radio device main body, allows the integration of the radio device and the antenna component to be designed; it also prevents impact to the antenna top, when the radio device has been dropped, from being directly transmitted to the base plate, reduces the load on the base plate, and can prevent the base plate from being damaged.

BRIEF DESCRIPTION OF THE DRAWINGS

FIGS. 15*a, b, c*, and *d* each depict a step in the manufacture of a conventional helical antenna.

DESCRIPTION OF THE PREFERRED EMBODIMENTS

Methods for manufacturing the helical antenna of the present invention and embodiments of the helical antenna are described below with reference to FIG. 1.

Figure 1A:
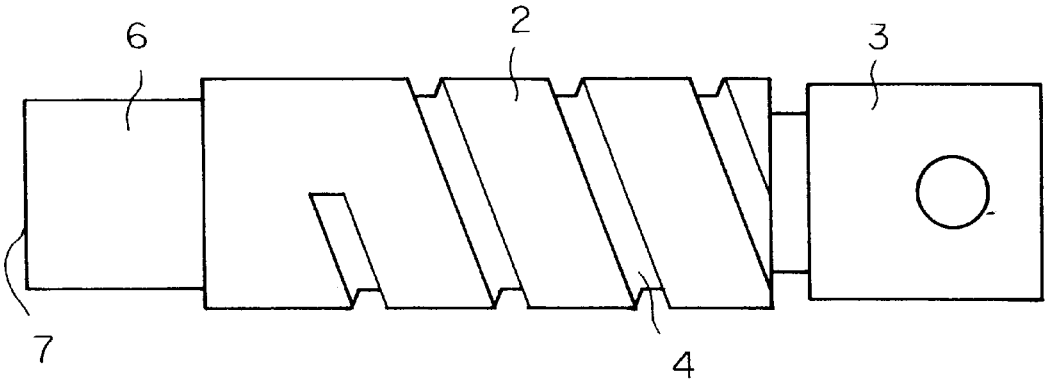
FIG. 1*a* is a front view of the molded element serving as the basis for manufacturing the helical antenna pertaining to the present invention.
Figure 1B:
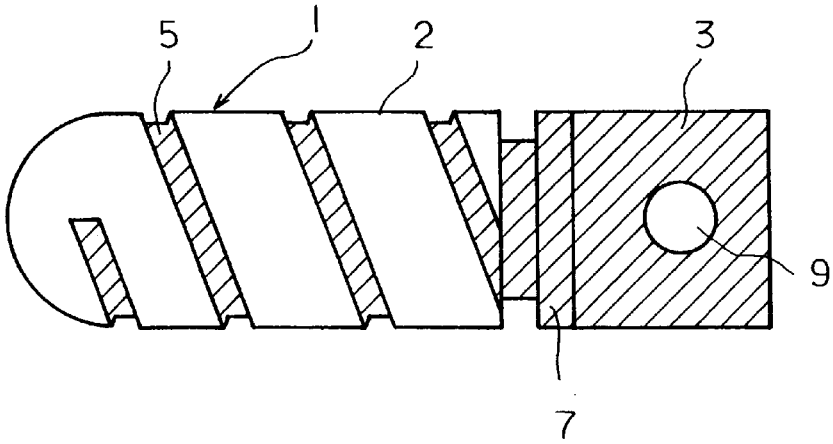
FIG. 1*b* is a front view of the helical antenna pertaining to the present invention.
Figure 1C:
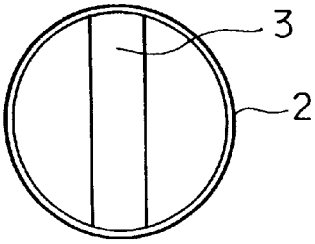
FIG. 1*c* is a bottom view of the helical antenna pertaining to the present invention.

As shown in FIG. 1*a*, a molded element is formed with a spiral groove 4 around an insulated coil main body 2, with a mounting component 3 at one end and a cutting boss component 6 at the other end. The helical antenna 1 shown in FIG. 1*b* is fabricated by then chucking the aforementioned boss component 6, plating the entire surface of the coil main body 2 and the mounting component 3 with a conductive layer 7 consisting of a metal, cutting and grinding off the plating layer with a lathe or the like except from the aforementioned groove component 4 and mounting component 3, and cutting off the aforementioned boss component 6. The plating treatment preferably involves applying copper as the substrate to a thickness of about 5 $\mu$m, followed by nickel plating to a thickness of about 1 $\mu$m. FIG. 1*c* is a bottom view.

As may be seen by referring to FIG. 1, the main body has a cylindrical shape, and the boss component 6 can be used as a chucking component during cutting and machining, allowing the cutting and machining work to be easily managed.

A conductive layer 7 is formed over the entire mounting component 3 provided at one end, and this conductive layer 7 is electrically connected with the coil component 5 through the bottom surface of the coil main body 2. As a result, simply mounting the mounting component 3 on a radio device main body allows the helical antenna to be electrically connected to the radio device main body with fewer irregularities in the electrical properties, and it can be mechanically fixed. Since the present invention has a boss component 6 that serves as a chucking component, the mounting component 3 or coil main body 2 can be easily machined. The groove component 4 in FIG. 1 was integrally provided when the first molded element was molded, but it may also be formed by molding a first molded element with the mounting component 3 at one end of the coil body 2 of the insulator and the cutting boss component 6 at the other end, and by then chucking the boss component to cut the groove.

Figure 2A:
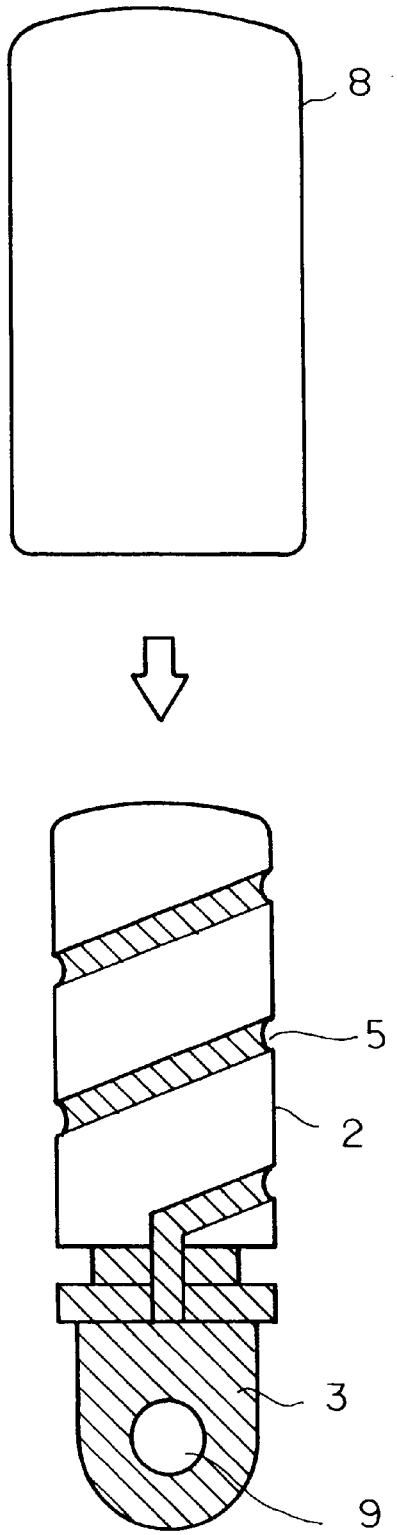
FIG. 2*a* depicts the assembled configuration of a first embodiment of the helical antenna pertaining to the present invention.
Figure 2B:
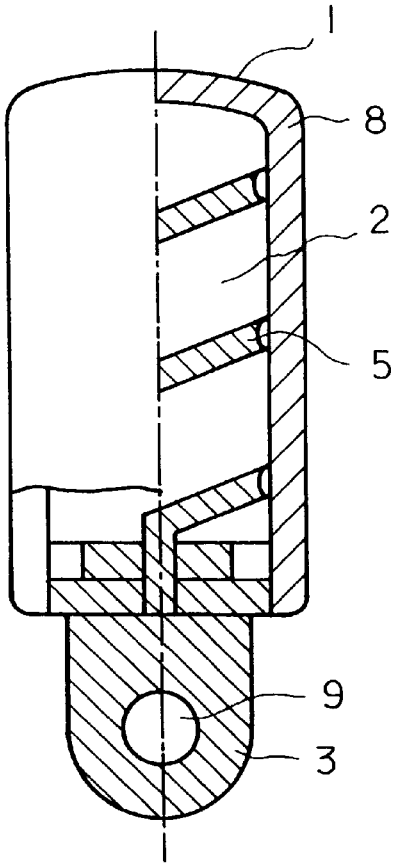
FIG. 2*b* is a half cross section of the configuration of the first embodiment of the helical antenna pertaining to the present invention.

The configuration of a first embodiment of the helical antenna obtained by the manufacturing method of the present invention is depicted in FIG. 2. FIG. 2*a* depicts the assembled configuration of the first embodiment, and FIG. 2*b* is a half cross section thereof.

As shown in FIG. 2, the configuration in the first embodiment is such that the spiral groove component 4 formed on the surface of the cylindrical insulator is plated, thereby forming the coil component 5, the mounting component 3 that is electrically connected with the coil component 5 is provided to the bottom, and a cover 8 is fitted onto the coil main body 2 and is integrated with it by adhesion or the like. The mounting component 3 is provided with a screw hole 9 allowing it to be screwed to a radio device main body.

Figure 3:
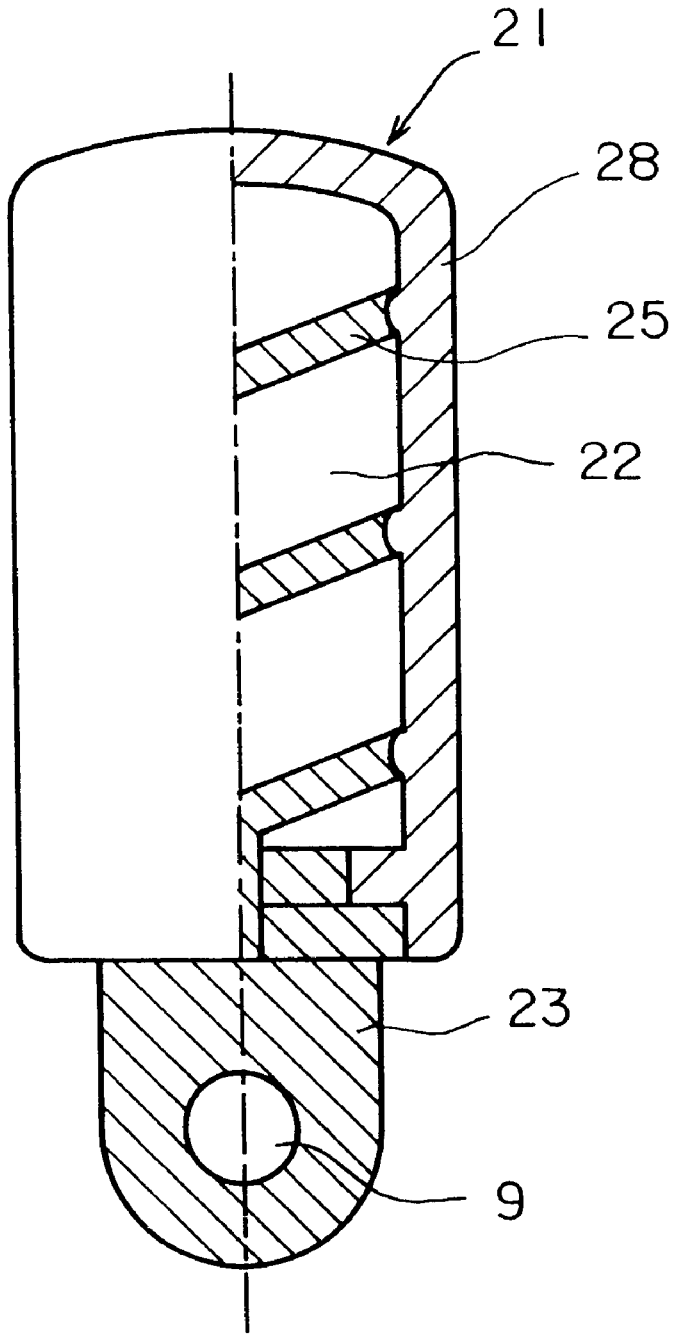
FIG. 3 depicts the configuration of a second embodiment of the helical antenna pertaining to the present invention.

The configuration of a second embodiment of the helical antenna obtained by the manufacturing method of the present invention is illustrated in the half cross section in FIG. 3.

As shown in FIG. 3, the configuration of the second embodiment is modeled in such a way that a spiral groove around a coil main body 22 is plated, resulting in the formation of a coil component 25, the bottom is provided with a mounting component 23 that is electrically connected with the coil component 25, and a cover 28 is integrated with the coil body 22 by insert molding or the like on the coil main body 22. The mounting component 23 is then provided with a screw hole 9 allowing it to be screwed to a radio device main body.

The cover 28 is integrally molded with the coil main body 22 in this manner, thereby rendering means for adhesion or the like unnecessary and allowing the manufacturing costs to be lowered.

Figure 4B:
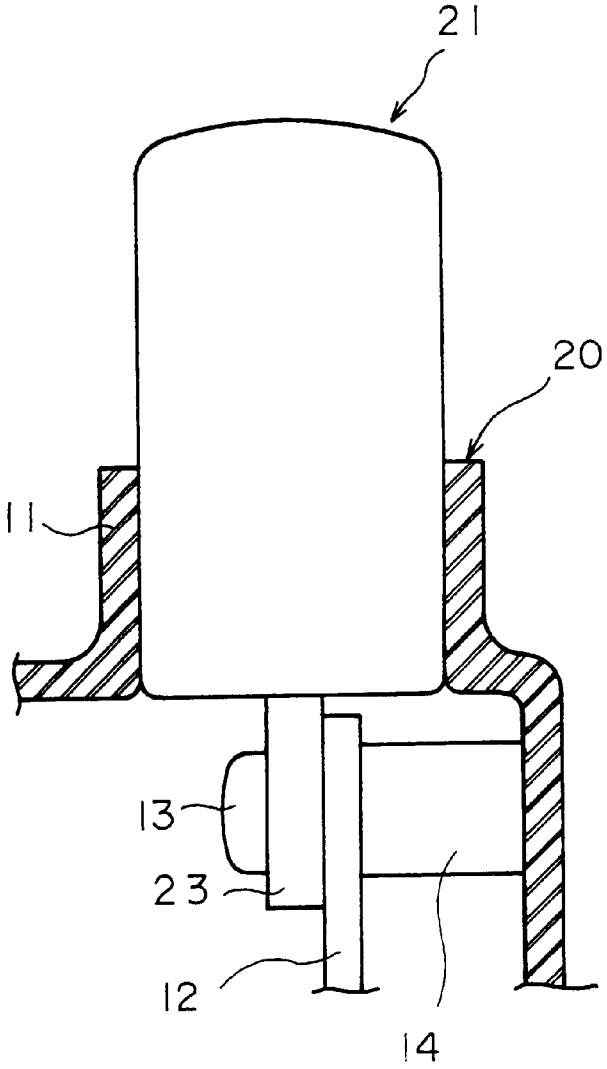
FIG. 4*b* depicts the connection with a base plate in the FIG. 4*a* of the helical antenna mounted on a portable radio device main body.
Figure 4A:
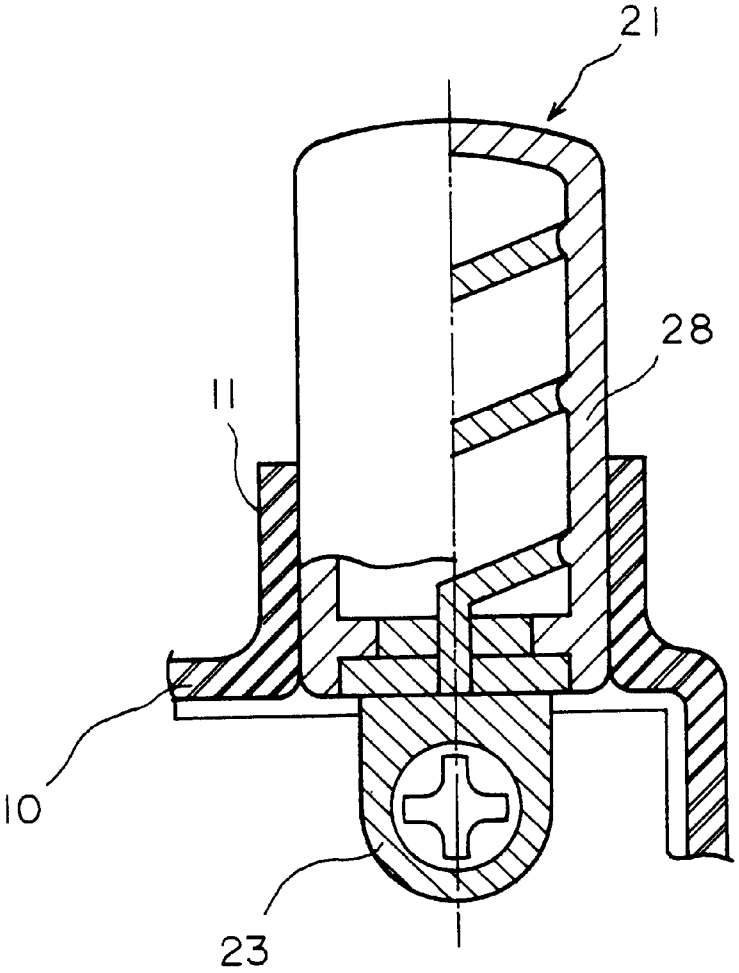
FIG. 4*a* is a half cross section of an example of the helical antenna of FIG. 3 mounted on a portable radio device main body.

FIG. 4 depicts the configuration of an embodiment in which the helical antenna of the present invention is mounted on a portable radio device main body. Here, FIG. 4*a* is a half cross section, and FIG. 4*b* depicts the connection with the base plate.

FIG. 4 depicts a mounted example of the helical antenna having the configuration of the second embodiment shown in FIG. 3, but it is mounted essentially in the same manner as the helical antenna 1 having the configuration in the first embodiment depicted in FIG. 2.

As indicated in FIGS. 4*a* and 4*b*, the case 10 of a radio device main body is provided with a cylindrical rim 20 serving as an antenna retaining component 11, the helical antenna 21 is fitted into the antenna retaining component 11, and the radio device case 10 retains the antenna outer diameter, allowing it to be mounted on a portable radio device.

At this time, the helical antenna 21 mounting component 23 is fixed to a radio device boss 14 by means of the portable radio device base plate 12 and a mounting fastener 13. In this way, the radio device case 10 itself directly holds the outer circumference of the antenna, thereby enhancing the mechanical strength and preventing the antenna component from being broken even when the radio device is dropped. The helical antenna 21 mounting component 23 may also be connected to the base plate by means of a connecting part instead of being directly fixed to the base plate.

Figure 5:
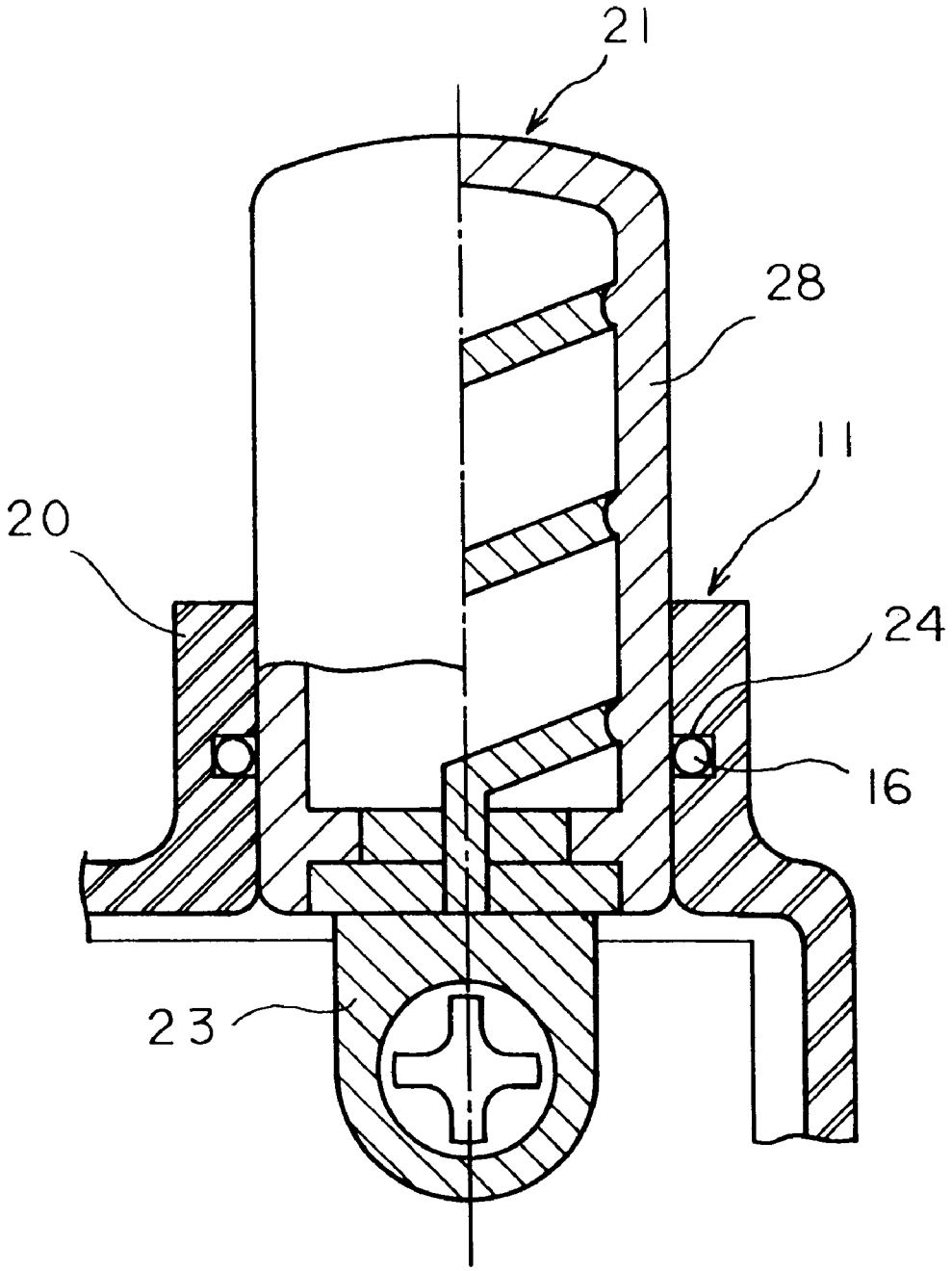
FIG. 5 depicts another example of the helical antenna of FIG. 3 mounted on a portable radio device main body.

FIG. 5 is a half cross section depicting the configuration of another embodiment of the helical antenna 21 of FIG. 3 mounted on a portable radio device main body, where the example shown in FIG. 4 is provided with a water-proof mechanism.

As shown in FIG. 5, the water-proof mechanism is provided with a groove 24 in part of the cylindrical rim 20 with which the radio device main body case 10 has been provided as an antenna retaining component 11, and an O-ring 16 is inserted into the groove. Although an O-ring is provided in the groove 24 of the antenna retaining component 11 of the radio device main body case in FIG. 4, a groove may also be provided around the bottom of the case of the helical antenna 21, and the O-ring may be inserted therein. The helical antenna mounting component 23 is mounted on the portable radio device in the same way as indicated in FIG. 4.

Figure 6:
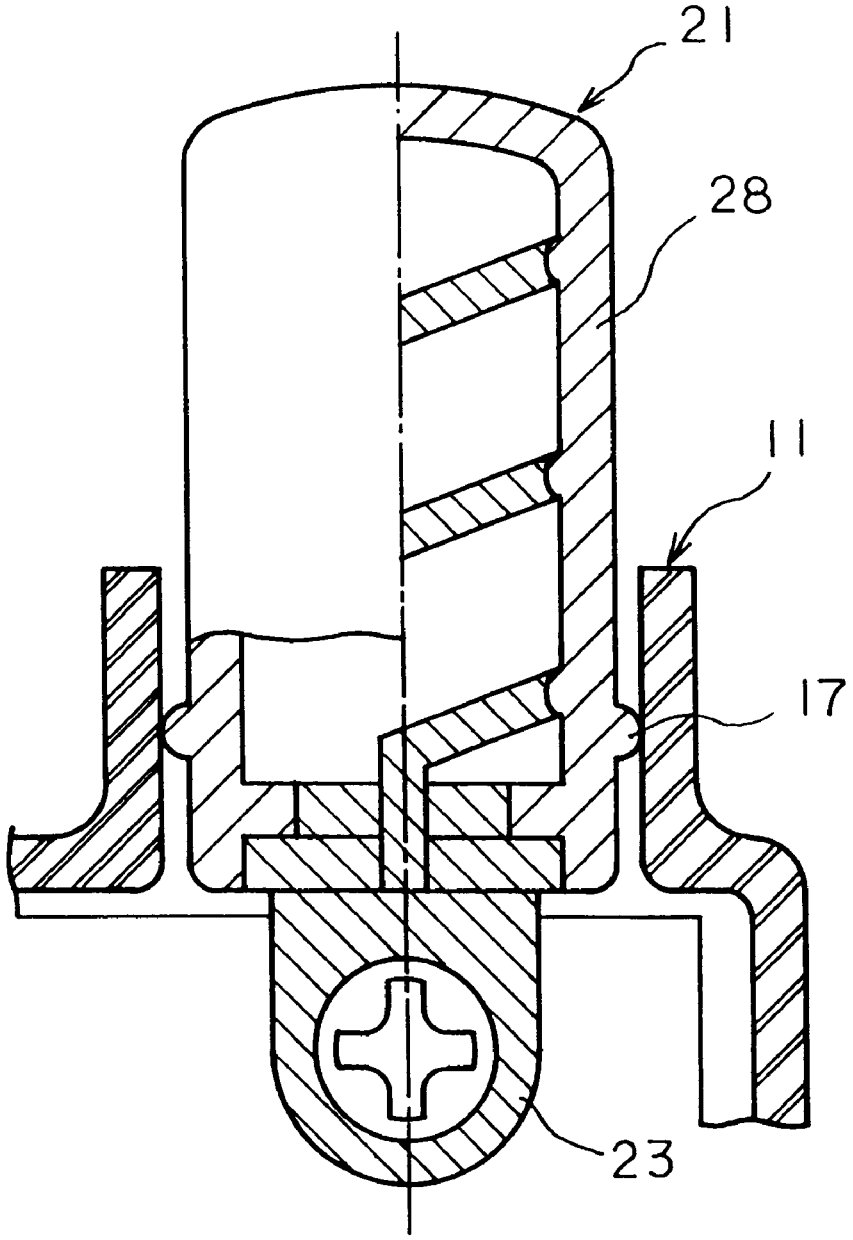
FIG. 6 depicts an example of a variant form of the helical antenna of FIG. 3 mounted on a portable radio device main body.

FIG. 6 depicts the configuration of an embodiment showing another water-proof mechanism for mounting a variant form of the helical antenna 21 of FIG. 3 on a portable radio device main body.

In this half cross section, an annular protruding rib 17 is provided around the outer peripheral surface of cover 28 at a location inserted into the antenna retaining component 11 near the bottom of the helical antenna 21. This increases the air-tightness and the water-proof performance when the antenna is inserted into the antenna retaining component 11. A resilient material, such as an elastomer, should be used as the material for the helical antenna 21 cover component 28. The helical antenna mounting component 23 is mounted on the portable radio device in the same manner as indicated in FIG. 4.

Figure 7:
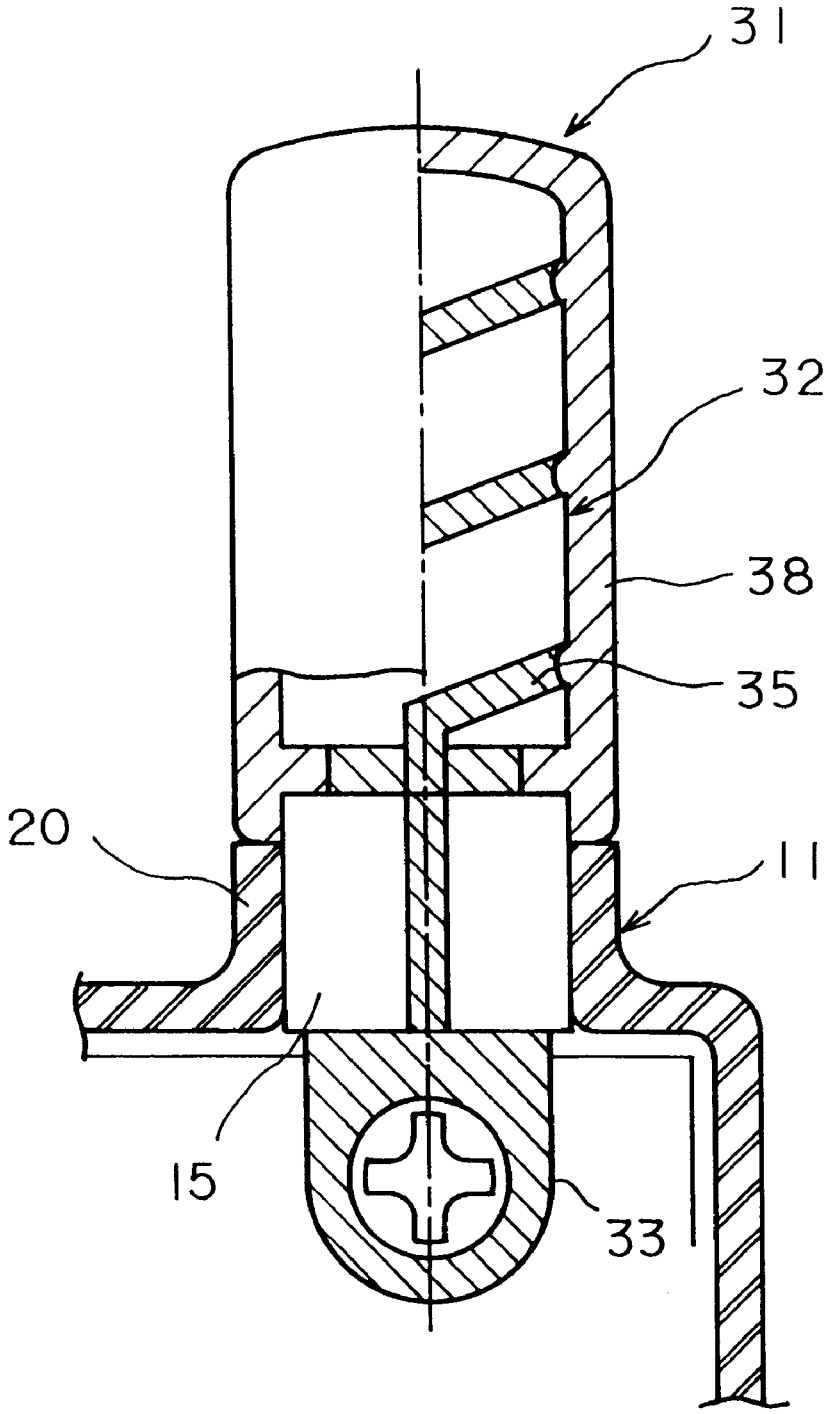
FIG. 7 depicts an example of a modified form of a modified form of the helical antenna of FIG. 3 mounted on a portable radio device main body.

FIG. 7 is of a configuration of another embodiment of a modification of the helical antenna 21 depicted in FIG. 3 with a different mounting structure on a portable radio device main body.

In this half cross section, the helical antenna 31 is such that the spiral groove component on the coil main body 32 is plated, resulting in the formation of a coil component 35, the bottom is provided with a fitting component 15 having roughly the same diameter as that of the coil main body, the bottom of the fitting component is equipped with a mounting component 33 that is electrically connected with the coil component, and a cover 38 is integrally formed with the coil main body 32 by means of molding or the like on the coil main body 32. The mounting component 33 is provided with a screw hole allowing it to be screwed to a radio device main body.

The radio device main body is provided with a cylindrical rim 20 having nearly the same wall thickness as the cover component of the helical antenna 31 and roughly the same diameter as the helical antenna 31.

When the mounting component 33 of the helical antenna 31 is fitted into the cylindrical rim component 20 of the radio device main body, the fitting component 15 is fitted into the rim component 20. The mounting component 33 is then fixed to the radio device boss by means of a base plate 12 of the portable radio device and a mounting fastener 13 shown in FIG. 4*b*, thereby joining the lower end of the helical antenna cover component 38 to the top end of the cylindrical rim component 20.

This mounting allows the integration of the radio device and the antenna component to be designed, prevents impact to the antenna top from being directly transmitted to the base plate when the radio device has been dropped, and can prevent the base plate from being damaged.

Figure 8B:
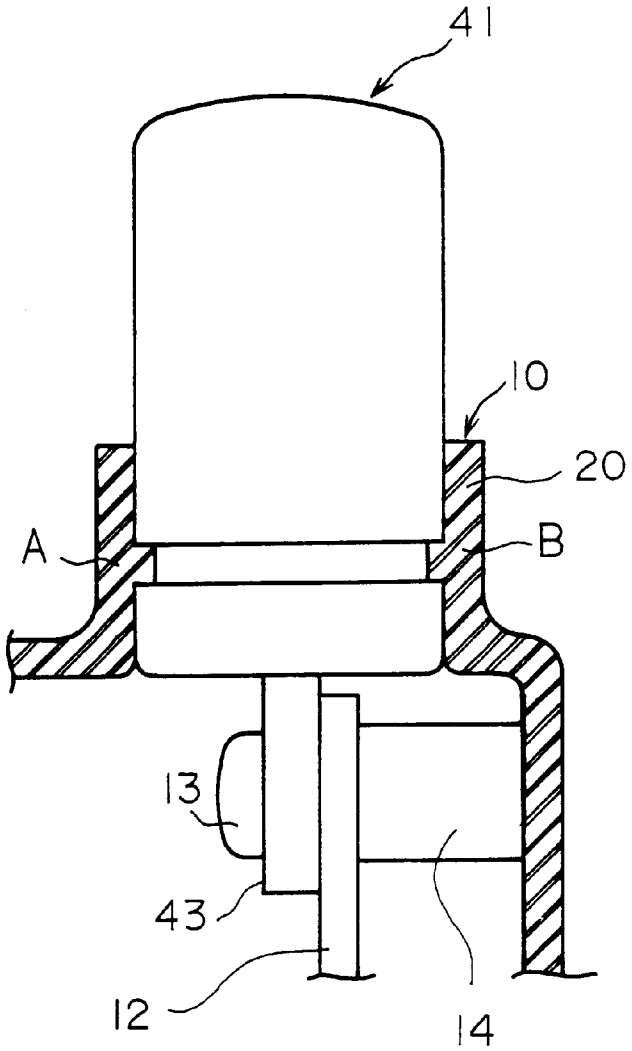
FIG. 8*b* depicts the connection with a base plate in the FIG. 8*a* example of the helical antenna of the present invention mounted on a portable radio device main body.
Figure 8A:
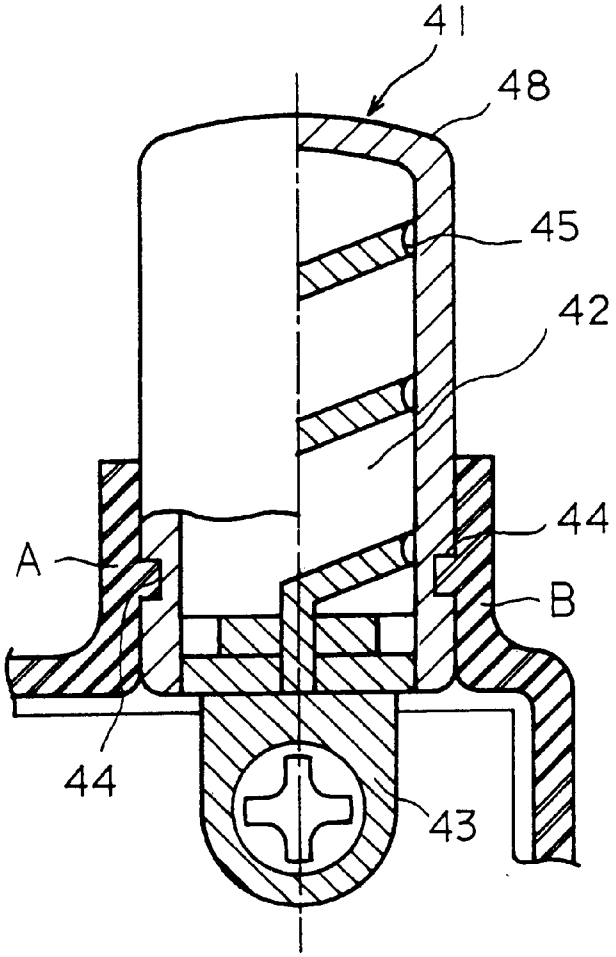
FIG. 8*a* is a half, cross section of an example of a modified form of the helical antenna of FIG. 2*b* mounted on a portable radio device main body.

Another embodiment with a different mounting structure on a portable radio device main body in the present invention is depicted in FIG. 8 as a modification of the configuration in the first embodiment. FIG. 8*a* is a half cross section, and FIG. 8*b* depicts the connection with the base plate.

The configuration of the embodiment depicted in FIG. 8 is such that the spiral groove component on a coil main body 42 is plated, resulting in the formation of a coil component 45, the bottom is provided with a mounting component 43 that is electrically connected, and a cover 48 is fitted onto the coil main body 42. A concave groove 44 is provided around the outer periphery near the bottom of the cover 48. A convex component is provided around the inner periphery of the cylindrical rim of the radio device main body case, and the convex and concave components are fitted together when the helical antenna 41 is inserted into the rim component 20. The cover component of the radio device main body is separated into a front A and rear B.

The mounting of the helical antenna 41 depicted in FIG. 8 to the radio device main body is described below.

First, the concave component 44 of the helical antenna 41 on which the cover 48 has been fitted is fitted to the convex component formed in the rim component 20 of the rear component B of the radio device case. The mounting component 43 of the helical antenna is then fixed to the radio device boss 14 by means of the base plate 12 of the portable radio device and the mounting fastener 13. The convex component formed on the rim component 20 of the front component A of the radio device case is fitted into the concave component 44 of the helical antenna 41, and the helical antenna 41 is incorporated into the radio device main body.

Because the cover 48 of the helical antenna 41 is sandwiched by the radio device case 10 and is thus fixed, it is not necessary to fix the cover 48 and coil main body 42 as a single antenna unit is, and the costs can be reduced.

Figure 9:
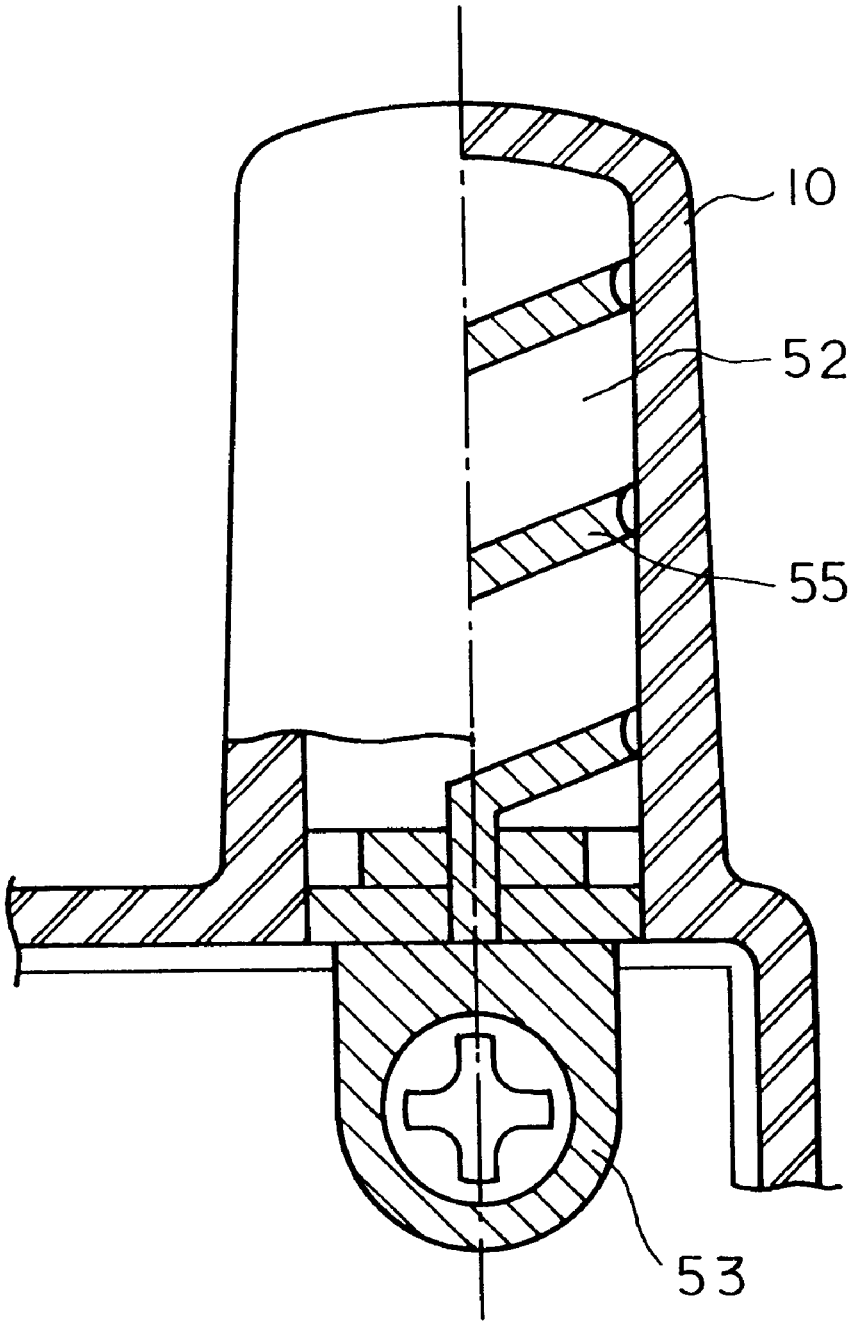
FIG. 9 depicts another example of the helical antenna of the present invention mounted on a portable radio device main body.

FIG. 9 is a half cross section of the configuration of another embodiment of a mounting mechanism for the helical antenna obtained by the manufacturing method of the present invention.

In the configuration of the embodiment depicted in FIG. 9, the spiral groove on a coil main body 52 is plated, resulting in the formation of a coil component 55, and the bottom is provided with an electrically connected mounting component 53. Thus constructed, the coil main body 52 is fixed by being fitted into an antenna cover integrally formed with a radio device case 10. Because the radio device case 10 is thus integrated with the cover of the antenna, the water-proofness and strength can be increased, the design results in an integrated impression, and manufacturing costs can be lowered.

Figure 10A:
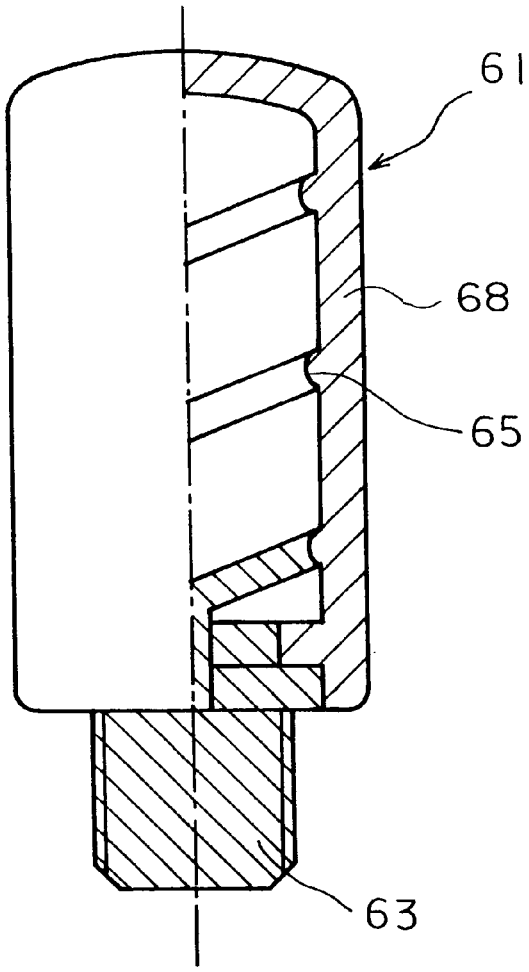
FIG. 10*a* depicts the configuration of a third embodiment of the helical antenna of the present invention.
Figure 10B:
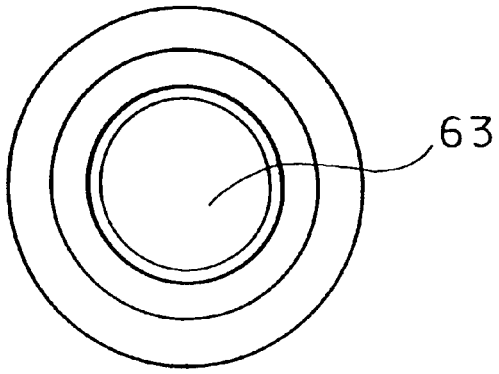
FIG. 10*b* is a bottom view depicting the configuration of the third embodiment of the helical antenna of the present invention.

FIGS. 10*a* and 10*b* depict the configuration of another embodiment of the helical antenna obtained by the manufacturing method in the present invention.

The helical antenna 61 depicted in FIG. 10 is such that the spiral groove component on the coil main body is plated, resulting in the formation of a coil component 65, the bottom is provided with an electrically connected mounting component 63, and the mounting component 63 is threaded to allow it to be screwed to the main body of the radio device. When the helical antenna is thus screwed to the radio device main body, it can be easily joined with the radio device main body without opening the radio device case 10.

In FIG. 10, the helical antenna cover was integrally formed with the coil main body, but a separately provided cover may be fitted.

Figure 11B:
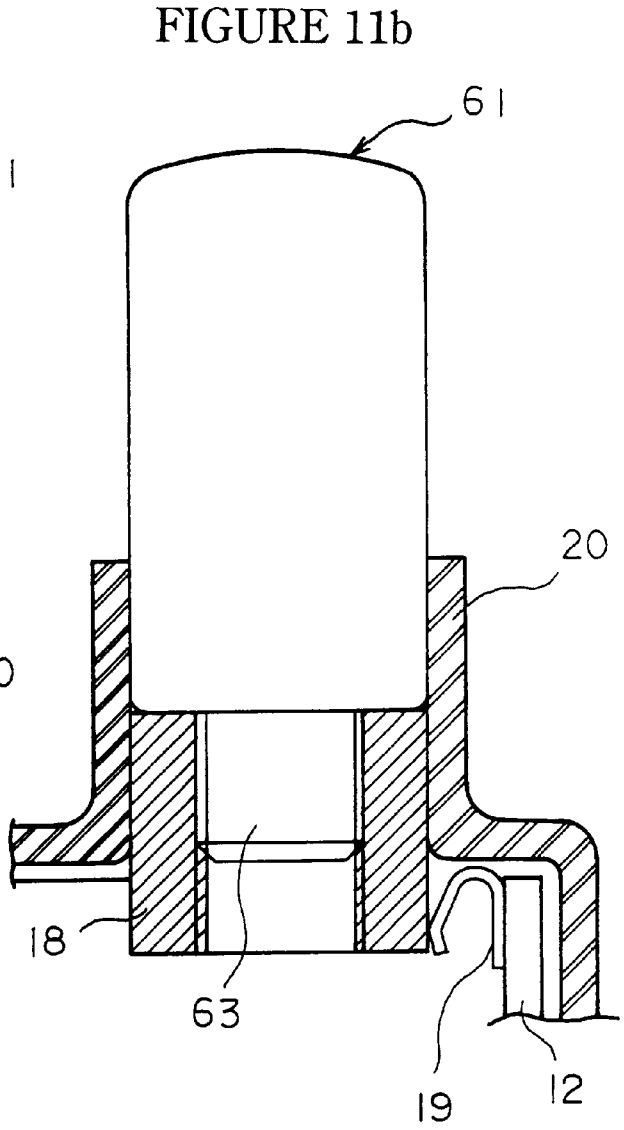
FIG. 11*b* depicts the connection with a base plate in the FIG. 11*a* example of the helical antenna of the present invention mounted on a portable radio device main body.
Figure 11A:
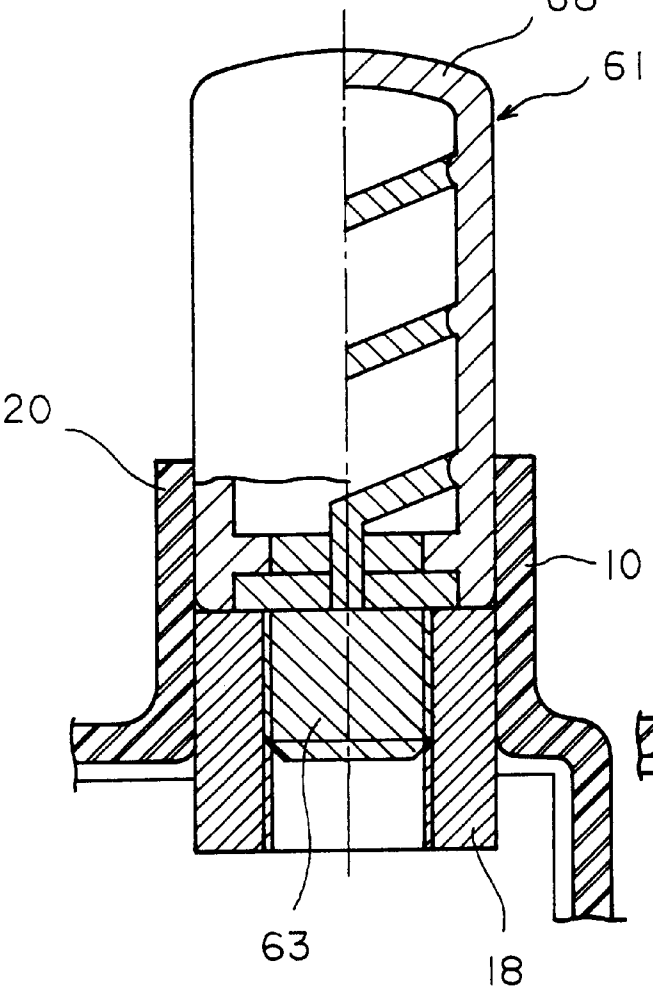
FIG. 11*a* is a half cross section depicting an example of the helical antenna of FIG. 10 mounted on a portable radio device main body.

FIG. 11 is of the configuration of an embodiment in which a screwing type of helical antenna 61 to which the mounting component depicted in FIG. 10 has been screwed is mounted on a portable radio device main body. FIG. 11*a* is a half cross section, and FIG. 11*b* depicts the connection with the base plate.

As shown in FIGS. 11*a* and 11*b*, a mounting nut 18 is integrally fixed beforehand to the inner periphery of the cylindrical rim component 20 with which the case 10 of the radio device main body is provided. The helical antenna 61 is then inserted into the rim component 20, and the mounting component 63 is screwed to the mounting nut 18, so as to fix the helical antenna to the radio device main body.

At this time, the mounting nut 18 of the helical antenna is electrically joined with the radio device base plate 12 of a portable radio device or the like by means of a contact terminal 19.

Figure 12B:
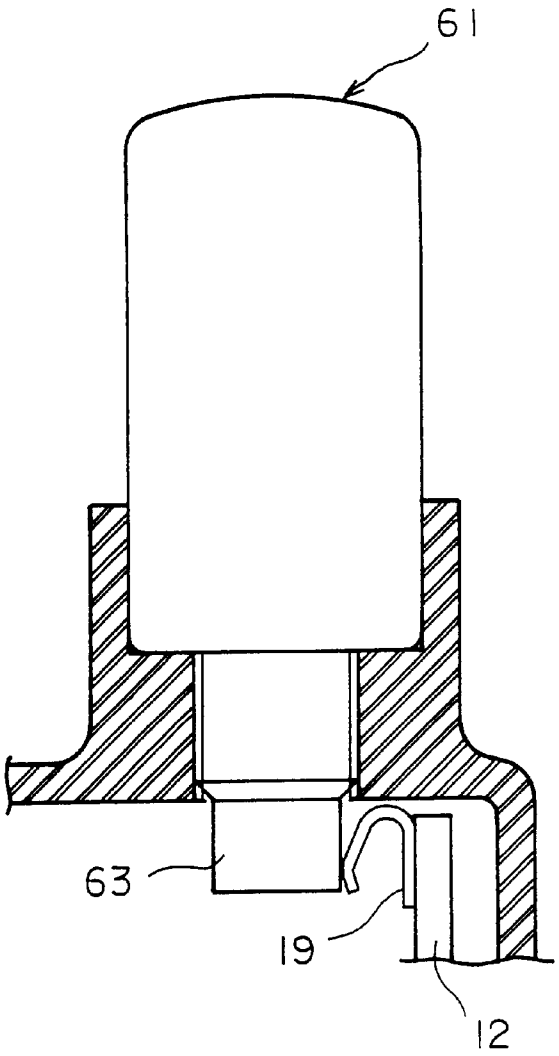
FIG. 12*b* depicts the connection with a base plate in the FIG. 12*a* example of the helical antenna of the present invention mounted on a portable radio device main body.
Figure 12A:
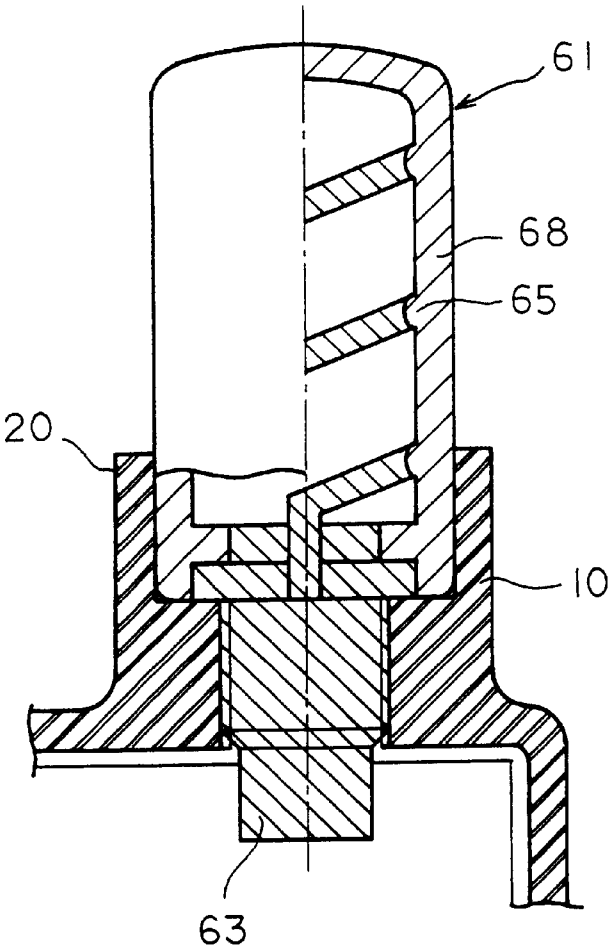
FIG. 12*a* is a half cross section depicting another example of the helical antenna of FIG. 10 mounted on a portable radio device main body.
Figure 13:
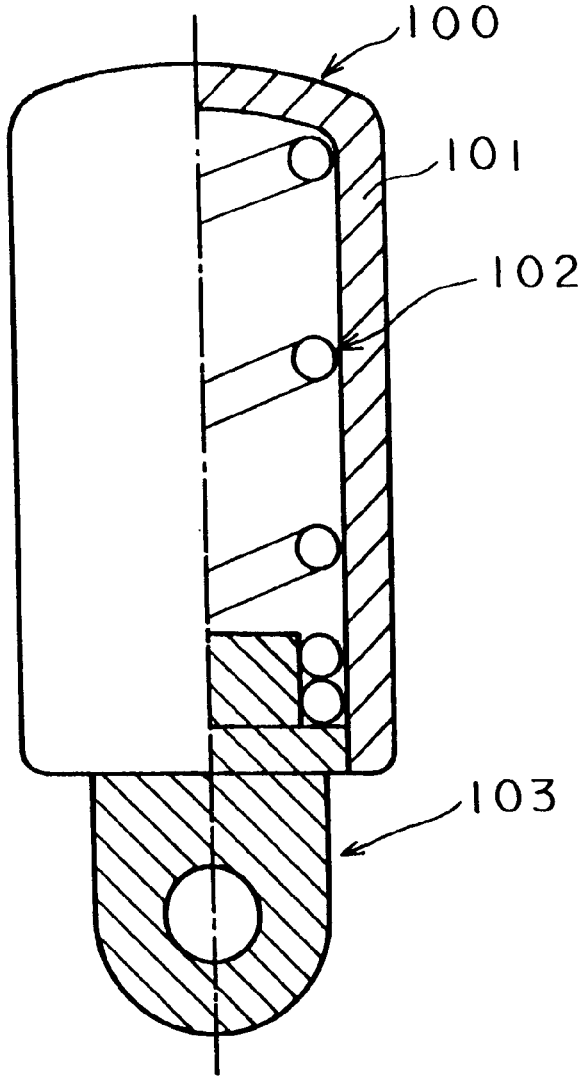
FIG. 13 depicts a conventional helical antenna.
Figure 14:
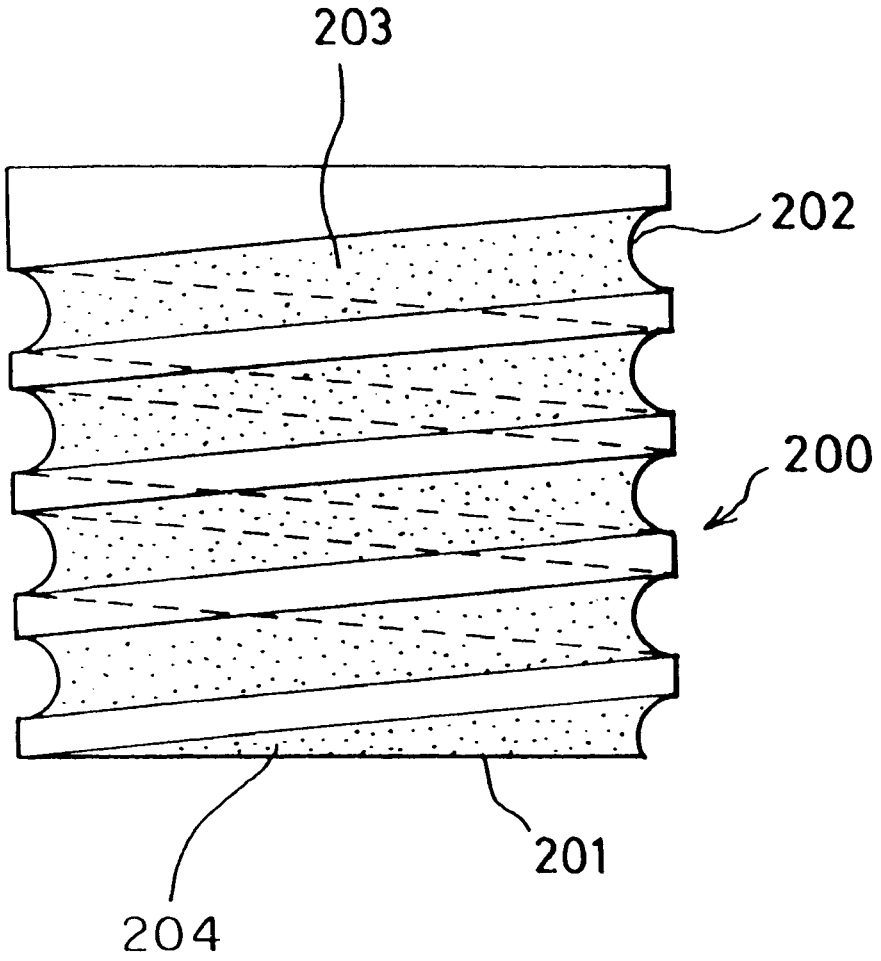
FIG. 14 depicts another example of a conventional helical antenna.

FIG. 12 depicts the configuration of another embodiment of a screwing type of helical antenna 61 to which a mounting component is screwed. FIG. 12*a* is a half cross section, and FIG. 12*b* depicts the configuration of the connection with a base plate.

As shown in FIGS. 12*a* and 12*b*, threading for screwing the helical antenna 61 is previously provided on the inner periphery of the cylindrical rim component 20 with which the case 10 of a radio device main body has been equipped. The helical antenna is fixed to the radio device main body by screwing the mounting component 63 of the helical antenna to the radio device main body. In this method, no nut is needed, allowing manufacturing costs to be reduced. The mounting component 63 of the helical antenna may be extended and lengthened, so as to bring the tip of the mounting component 63 into contact with the contact terminal 19 when it has been completely mounted, allowing it to be electrically connected with the radio device base plate 12 of the portable radio device.

Because the boss component can be used as a chucking component during cutting and machining in the method for manufacturing the helical antenna pertaining to the present invention, it can be held when cut, regardless of the shape of the mounting component, allowing the cutting and machining work to be managed more easily.

Because the helical antenna of the present invention is constructed as described above, the coil main body and mounting component can be electrically connected in an integral manner, and the mounting component can be directly fixed to the base plate of a radio device main body, allowing irregularities in the electrical properties to be reduced.

Manufacturing costs can be lowered by integrally molding the cover component with the coil main body, and an O-ring can be inserted into the cover component to increase the air-tightness and improve the water-proof function. When the helical antenna is incorporated in the radio device main body using the case cover of the radio device as the cover for the coil main body, no separate cover is needed for the coil main body, the air-tightness is increased, and no additional water-proof means is needed.

A structure in which the bottom end of the cover component is joined to the cylindrical rim of a radio device main body, or a structure in which the mounting component is threaded and easily screwed onto the radio device main body, allows the integration of the radio device and the antenna component to be designed; it also prevents impact to the antenna top, when the radio device has been dropped, from being directly transmitted to the base plate, reduces the load on the base plate, and can prevent the base plate from being damaged.

What is claimed is:

1. A method for manufacturing a radio device helical antenna, comprising the steps of:

chucking a cutting boss component of a first molded element that has a spiral groove formed around an insulator and that has a mounting component at one end and said boss component at another, and plating these components with a layer of metal; and then removing the metal layer except from the said groove and mounting component, and subsequently cutting off said boss component to provide a coil main body that is mountable on a radio device.

2. The method of claim 1 including the step of mounting said mounting component on the base plate of a radio device main body so as to electrically connect the said helical antenna with the said radio device main body.

3. The method of claim 2, further comprising fitting a cover over said coil main body.

4. The method of claim 3, further comprising the step of integrating the cover with the coil main body.

5. The method of claim 3, further comprising the step of forming an annular protruding rib around the outer periphery of said cover near the bottom of said cover.

6. The method of claim 3, further comprising the steps of forming a groove around said cover near the bottom of said cover, and inserting an O-ring in said groove.

7. The method of claim 3, further comprising the steps of forming a concave groove around the outer periphery near the bottom end of said cover, and fitting said concave groove into a convex component formed around the inner periphery of a cylindrical antenna retaining component formed on a case of said radio device main body.

8. The method of claim 2, further comprising the steps of forming spiral threading on said mounting component, and mounting said helical antenna on said radio device by thread engaging said threaded mounting component with said radio device main body.

9. The method of claim 1, further comprising the step of inserting, between said mounting component and the bottom of said coil main body, a fitting component of roughly the same diameter as that of the coil main body, and electrically connecting said mounting component to said coil main body.

10. The method of claim 2 wherein said mounting step comprises inserting and fixing said coil main body into a housing component that is integrally formed with said radio device main body, so as to incorporate said coil main body in the radio device main body case.

* * * * *